United States Patent [19]

Liu

[11] Patent Number: 4,949,926

[45] Date of Patent: Aug. 21, 1990

[54] CLAMPING ASSEMBLY FOR A VENETIAN BLIND

[76] Inventor: Tai-Ping Liu, No. 118-1, Kuang Hsing Li, Tou Fen Chen, Miao Li Hsien, Taiwan

[21] Appl. No.: 359,545

[22] Filed: Jun. 1, 1989

[51] Int. Cl.[5] ..... A47H 1/00

[52] U.S. Cl. ..... 248/251; 16/94 R; 160/178.1; 160/902

[58] Field of Search ..... 248/251, 262, 544, 542, 248/223.1; 160/902, 178.1; 16/94 R

[56] References Cited

U.S. PATENT DOCUMENTS

| | | | |
|---|---|---|---|
| 3,636,342 | 1/1972 | Blount | 248/225.1 |
| 3,927,437 | 12/1975 | Ford | 16/94 R |
| 4,411,401 | 10/1983 | Anderson | 248/251 X |
| 4,438,897 | 3/1984 | Vecchiarelli | 248/251 X |
| 4,475,706 | 10/1984 | Anderson | 248/251 X |
| 4,802,644 | 2/1989 | Oskam | 248/251 |

FOREIGN PATENT DOCUMENTS

| | | | |
|---|---|---|---|
| 736565 | 11/1932 | France | 248/316.4 |

*Primary Examiner*—David L. Talbott

*Attorney, Agent, or Firm*—Browdy and Neimark

[57] ABSTRACT

A clamping assembly for a headrail of a venetian blind including a bracket which is L-shaped and composed of a horizontal plate and a vertical plate with holes formed on the each of the plate. The horizontal plate has a pair of inward stops, a pair of holders and a pair of inward flanges formed integrally on two side plates of the bracket. The holders are engagable with the first flange of the headrail. A slidable block has a pair of second holders and a pair of recesses. A channel is formed below each recess for receiving the inward flange of the bracket. One or more spring members are disposed within the recesses and bear with one end against the stop. The spring members are able to force the slidable block move backward so that the holders and the second holders clamp the flanges of the headrail easily.

1 Claim, 4 Drawing Sheets

CLAMPING ASSEMBLY FOR A VENETIAN BLIND

FIELD OF THE INVENTION

The present invention relates to a clamping assembly, and more particularly to a clamping assembly for a headrail of a venetian blind.

BACKGROUND OF THE INVENTION

Venetian blinds are widely used. People are eager to have a convenient clamping device for a headrail of the venetian blind. Therefore, a clamping device was developed as shown in FIGS. 6 and 7. The device comprises an L-shaped bracket 8 and a U-shaped holder 9. A resilient blade 92 and a curved surface 94 are formed on the legs of the holder 9, respectively. Two holes 88 and 98 are formed respectively on the bracket 8 and the holder 9 for being clamped together by a screw 81 and a nut 82. Several holes 89 are formed on a vertical leg of the bracket 8 so that the bracket 8 can be fixed onto a vertical wall or surface. A U-shaped headrail 7 with two flanges 72 is force-fitted onto the holder 9 with one flange 72 lying above the resilient blade 92 of the holder 9, and the other flange is forced along the curved surface 94 and engaged above the curved surface 94.

This device is suitable for a specifically sized headrail 7 only. It should have many different sizes for clamping different sized headrails 7. Besides, the bracket 8 is suitable for being fixed onto a vertical wall or surface only. It can not be fixed onto a ceiling or a horizontal surface. This is very inconvenient.

The present invention has arisen to mitigate and/or obviate the afore-described disadvantages of the conventional clamping device.

SUMMARY OF THE INVENTION

The primary object of the present invention is to provide a clamping assembly for a venetian blind, which is suitable for clamping different sized headrail easily.

Another object of the present invention is to provide a clamping assembly for a venetian blind, which is suitable for being fixed onto either a vertical wall or a ceiling.

Therefore, the present invention seeks to provide a clamping assembly for a headrail of a venetian blind including a bracket being substantially L-shaped and composed of a horizontal plate and a vertical plate with respective holes formed on the plates. The horizontal plate has a pair of inward stops, a pair of holders and a pair of inward flanges formed integrally on two side plates of the bracket. The holders are engagable with the first flange of the headrail. A slidable block has a pair of second holders and a pair of recesses. A channel is formed below each recess for receiving the inward flange of the bracket. One or more spring members are disposed within the recesses with one end bearing against the stop. The spring member forces the slidable block to move backward so that the holders and the second holders can clamp flanges of the headrail easily.

Further objects and advantages of the present invention will become apparent from a careful reading of the detailed description provided hereinbelow, with appropriate reference to the accompanying drawings.

DETAILED DESCRIPTION OF THE INVENTION

Figure 1:
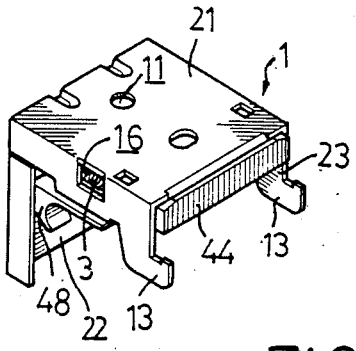
FIG. 1 is a perspective view of a clamping assembly for a venetian blind in accordance with the present invention.
Figure 2:
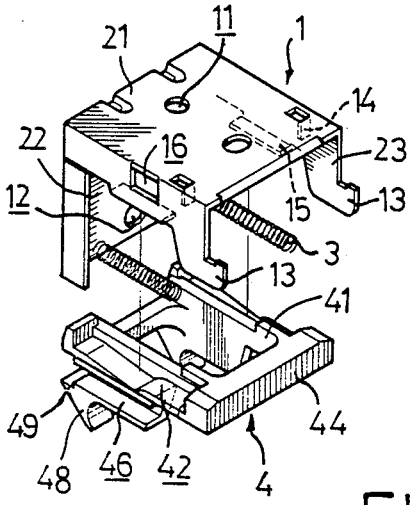
FIG. 2 is an exploded view of the clamping assembly of FIG. 1.

Referring to the drawings and initially to FIGS. 1 and 2, the clamping assembly for a venetian blind headrail in accordance with the present invention comprises an L-shaped bracket 1 and a slidable block 4. Several holes 11 and 12 are formed on a horizontal plate 21 and a vertical plate 22 of the bracket 1. A pair of L-shaped holders 13 are formed on a front edge of a pair of respective side plates 23. A pair of inward flanges 15 are formed on the lower ends of the side plates 23. A pair of stops 14 are disposed inwards on the two sides of the horizontal plate 21 proximate to the front end. A pair of long holes or rectangular holes 16 are formed on the side plates 23 of the bracket 1 and located slightly behind the stops 14.

The slidable block 4 is generally O-shaped with two recesses 42 formed on the outer sides of the two side legs 41. A guide channel 46 is formed on the lower side of each recess 42 of the side legs 41. A tapered surface 48 is formed on the lower rear side of each guide channel 46. A second holder 49 is formed on the upper end of the tapered surface 48. Two spring members 3 can be inserted respectively into the recesses 42 of the slidable block 4. A handle 44 (or a front leg) is formed on the front edge of the slidable block.

For disposing the slidable block 4 in the bracket 1, the stops 14 are formed horizontally before engagement. Then, the slidable block 4 is inserted horizontally from the front side into the bracket 1, in which the spring members 3 are kept in the recesses 42 respectively. The inward flanges 15 are slidably disposed in the guide channels 46, respectively. A sharp element (not shown) is inserted into the front end of each longer hole 16 and each spring member 3 is pressed backwards. The stops 14 are folded to an inward vertical position (FIG. 2). Then the spring member 3 is released so that the spring member 3 bears between the stop 14 and the rear end of the recess 42. The slidable block 4 is forced backwards relative to the bracket 1 by the spring member 3 and located within the bracket 1 when no external forces are applied (FIG. 1).

Figure 3:
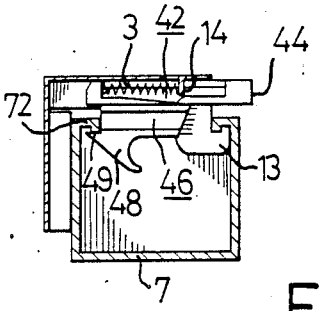
FIGS. 3 and 4 are cross-sectional views, showing the operation of the clamping assembly of FIG. 1.
Figure 4:
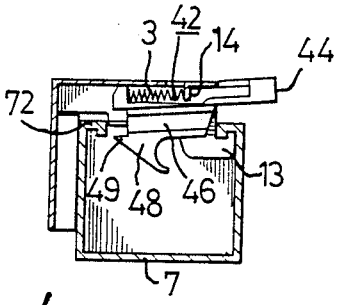

Referring next to FIGS. 3 and 4, for clamping a headrail 7 of a venetian blind, a flange 72 of the headrail 7 is hooked on the holders 13. Then, the other flange 72 can be forced along the tapered surface 48 of the slidable block 4 in order to force the slidable block 4 to move forward until the flange 72 passes the tapered surface 48 and is clamped by the second holder 49 (FIG. 3).

Figure 5:
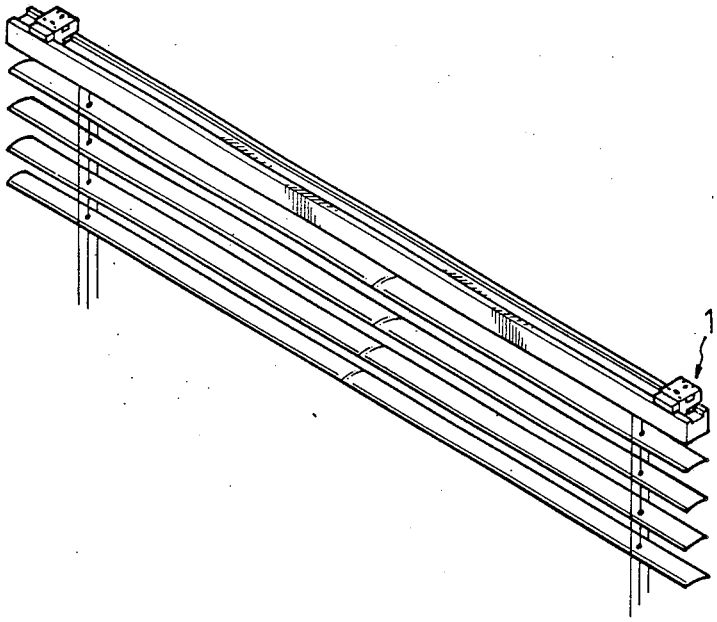
FIG. 5 is a perspective working view of the clamping assembly of FIG. 1.
Figure 6:
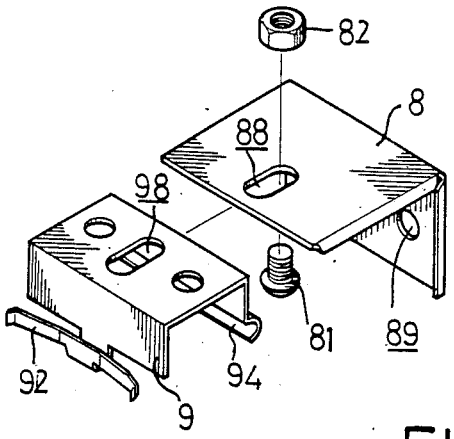
FIG. 6 PRIOR ART
FIG. 6 is an exploded view of a prior art clamping device.
Figure 7:
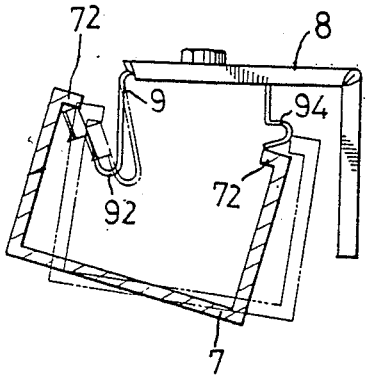
FIG. 7 PRIOR ART
FIG. 7 is a plane view showing the operation of the clamping device of FIG. 6.

Alternatively, without the tapered surface 48, the slidable block 4 can be pulled forward by the handle 44 so that the headrail 7 can also be clamped easily by the clamping assembly in accordance with the present invention (FIG. 5). Conversely, the headrail 7 can be moved easily by pulling the handle 44 slightly forward and disengaging the flange 72 and the second holder 49. Furthermore, only one spring member 3 can achieve the same results.

Accordingly, the present invention has the following advantages:

(a) The clamping assembly is suitable for various sized headrails of venetian blinds;

(b) The clamping processes of clamping and removing the headrails are simple and easy; and (c) The clamping assembly can be fixed, either on a vertical wall (or surface) by the holes 12 on the vertical plate 22, or on a ceiling or horizontal wall by the holes 11 on the horizontal plate 21.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A clamping assembly for a headrail of a venetian blind, said headrail being substantially U-shaped with a first flange and a second flange formed on an upper end thereof, said clamping assembly comprising: a bracket being substantially L-shaped and composed of a horizontal plate and a vertical plate, said horizontal plate having a pair of stops extended downward from a lower surface thereof, a pair of side plates being formed on both sides of said horizontal plate and extending downward, a first holder being provided on a front end of each said side plate; a flange being formed on a lower end of each said side plate and extending inwards of said bracket; a hole being formed in each said side plate;

a slidable block having a pair of recesses longitudinally formed on both ends thereof, a channel being formed below each recess and being parallel to said recess, said inward flanges of said bracket being slidably received in said channels, a second holder being formed on a rear and lower end of each said channel, a tapered surface being formed on a lower end of each said second holder;

a spring member being insertable through each said hole and being disposed within each said recess so that each said spring member being biased between a rear end of each said recess and a respective stop, a handle being formed on a front end of said slidable block; and said first holders of said bracket being engageable with said first flange of said slidable block, said spring member biasing said second holders of said slidable block to move rearward relative to said bracket in order to engage with said second flange of said headrail; said tapered surfaces of said slidable block facilitating an engagement of said second holders with said second flange of said headrail; and said slidable block being pulled forward relative to said bracket so that said clamping assembly can be readily removed from said headrail.

* * * * *